US007911421B2

(12) United States Patent
Jung et al.

(10) Patent No.: US 7,911,421 B2
(45) Date of Patent: Mar. 22, 2011

(54) DRIVING DEVICE AND METHOD FOR PLASMA DISPLAY PANEL

(75) Inventors: Yun Kwon Jung, Gumi-si (KR); Seung Woo Woo, Daegu (KR)

(73) Assignee: LG Electronics Inc., Seoul (KR)

( * ) Notice: Subject to any disclaimer, the term of this patent is extended or adjusted under 35 U.S.C. 154(b) by 771 days.

(21) Appl. No.: 11/166,118

(22) Filed: Jun. 27, 2005

(65) Prior Publication Data

US 2006/0109207 A1 May 25, 2006

(30) Foreign Application Priority Data

Nov. 22, 2004 (KR) ..... 10-2004-0096019

(51) Int. Cl.
*G09G 3/28* (2006.01)

(52) U.S. Cl. ..... 345/68; 345/60

(58) Field of Classification Search ..... 345/60–72; 315/169.4

See application file for complete search history.

(56) References Cited

U.S. PATENT DOCUMENTS

| | | | | |
|---|---|---|---|---|
| 6,104,362 | A * | 8/2000 | Kuriyama et al. | 345/63 |
| 6,720,940 | B2 | 4/2004 | Awamoto et al. | |
| 2003/0173903 | A1 * | 9/2003 | Takeuchi et al. | 315/169.2 |

FOREIGN PATENT DOCUMENTS

| | | | |
|---|---|---|---|
| CN | 1444198 | A | 9/2003 |
| EP | 0903719 | A2 | 3/1999 |
| EP | 1020838 | A1 | 7/2000 |
| EP | 1345199 | A2 | 9/2003 |
| EP | 1347435 | A2 | 9/2003 |
| EP | 1457960 | A2 | 9/2004 |
| JP | 10-39831 | A | 2/1998 |
| JP | 2002-358045 | A | 12/2002 |
| JP | 2004-206094 | A | 7/2004 |
| KR | 2003-0076189 | A | 9/2003 |
| KR | 10-2004-0080271 | A | 9/2004 |
| TW | 2003/06515 | A | 11/2003 |
| TW | 577039 | | 2/2004 |

* cited by examiner

*Primary Examiner* — Kevin M Nguyen
(74) *Attorney, Agent, or Firm* — Birch, Stewart, Kolasch & Birch, LLP

(57) ABSTRACT

A plasma display apparatus and a method of driving the plasma display apparatus are provided. According to an embodiment, the plasma display apparatus is driven by dividing a sub-field into at least an address period and a sustain period. The apparatus includes a timing controlling unit to vary a length of the sustain period according to a data pattern associated with at least one address electrode.

15 Claims, 9 Drawing Sheets

DRIVING DEVICE AND METHOD FOR PLASMA DISPLAY PANEL

This Nonprovisional application claims priority under 35 U.S.C. §119(a) on Patent Application No. 10-2004-0096019 filed in Korea on Nov. 22, 2004, the entire contents of which are hereby incorporated by reference.

BACKGROUND OF THE INVENTION

1. Field of the Invention

The present invention relates to a driving device and method for a plasma display panel (PDP), and more particularly, to a PDD including a driving device and using a driving method to recover a data voltage drop component occurring in an address discharge.

2. Description of the Background Art

Plasma display panel (PDP) displays a picture including a character or a graphic by exciting a phosphor using an ultraviolet ray of 147 nm, which is generated when an inert mixture gas such as He+Xe, Ne+Xe, or He+Ne+Xe is discharged.

FIG. 1 is a view illustrating a three-electrode alternate current surface discharge type PDP according to the background art. Referring to FIG. 1, the three-electrode alternate current surface discharge type PDP includes a scan/sustain electrode 11*a* and a common sustain electrode 12*a* formed on an upper substrate 10, and an address electrode 22 formed on a lower substrate 20. Each of the scan/sustain electrode 11*a* and the common sustain electrode 12*a* is formed of a transparent material, for example, of indium-tin-oxide (ITO). Metal bus electrodes 11*b* and 12*b* are formed at each of the scan/sustain electrode 11*a* and the common sustain electrode 12*a* to reduce resistance. An upper dielectric layer 13*a* and a protective film 14 are layered on the upper substrate 10 having the scan/sustain electrode 11*a* and the common sustain electrode 12*a* formed thereon. Wall charges are generated in plasma discharge and accumulated on the upper dielectric layer 13*a*. The protective film 14 prevents the upper dielectric layer 13*a* from being damaged by sputtering generated in the plasma discharge, and increases a secondary electron emission efficiency. In general, the protective film 14 is formed of magnesium oxide (MgO).

Meantime, a lower dielectric layer 13*b* and a barrier rib 21 are formed on the lower substrate 20 having the address electrode 22 formed thereon. A phosphor layer 23 is coated on surfaces of the lower dielectric layer 13*b* and the barrier rib 21. The address electrode 22 is formed in a direction of intersecting with the scan/sustain electrode 11*a* and the common sustain electrode 12*a*. The barrier rib 21 is formed in parallel with the address electrode 22, thereby preventing ultraviolet ray and visible ray, which are generated in the plasma discharge, from being leaked to an adjacent discharge cell. The phosphor layer 23 is excited by the ultraviolet ray to generate any one of red, green and blue visible light. The inert mixture gas such as He+Xe, Ne+Xe or He+Ne+Xe is injected into a discharge space of the discharge cell for discharge. The discharge space is provided between the upper and lower substrates 10 and 20 and the barrier rib 21. A method of expressing an image grayscale of the above-constructed PDP will be described with reference to FIG. 2.

FIG. 2 illustrates the method of expressing the image scale of the PDP of FIG. 1.

As shown in FIG. 2, the image grayscale is expressed with one frame divided into various sub-fields each sub-field having different light emission times. Each of the sub-fields is divided into a reset period for uniformly generating discharge, an address period for selecting the discharge cell, and a sustain period for embodying the grayscale depending on discharge times. For example, in case where an image is displayed in 256 grayscales, a frame period (16.67 ms) corresponding to 1/60 second is divided into eight sub-fields. Each of the eight sub-fields is again divided into a reset period, an address period and a sustain period. The reset period and the address period are the same a each sub-field, whereas the sustain period is increased in the ratio of $2^n$ (n=0, 1, 2, 3, 4, 5, 6, 7) at each sub-field. This increase in the sustain period is fixed and implemented automatically independent of any signal/voltage characteristics of the PDP. A driving waveform of the PDP driven with the divided sub-fields will be described as follows referring to FIG. 3.

FIG. 3 illustrates the waveform for describing the driving method for the PDP according to the background art. Referring to FIG. 3, the PDP is driven by dividing a sub-field into an initialization/reset period for initializing an entire picture, an address period for selecting a cell, and a sustain period for sustaining a discharge of the selected cell.

At a setup period (SU) of the initialization period, a ramp-up waveform (Ramp-up) is concurrently supplied to all scan electrodes (Y). The ramp-up waveform causes the discharge in cells of the entire picture. By the setup discharge, positive (+) wall charges are accumulated on the address electrode (X) and the sustain electrode (Z), and negative (−) wall charges are accumulated on the scan electrode (Y). After the supplying of the ramp-up waveform, a ramp-down waveform (Ramp-down) is supplied at a setdown period (SD) to generate a weak erasure discharge, thereby partially erasing excessive wall charges. The ramp-down waveform begins to drop from a positive voltage lower than the peak voltage of the ramp-up waveform to a ground voltage (GND) or a specific positive voltage level. By the setdown discharge, the wall charges are uniformly remained within the cells to stably generate an address discharge.

At the address period, a negative scan pulse (scan) is sequentially supplied to the scan electrodes (Y) and at the same time, a positive data pulse (data) is supplied to the address electrodes (X) in synchronization with the scan pulse (scan). While a voltage difference between the scan pulse and the data pulse is summed with a wall voltage generated during the initialization period, the address discharge is generated within the cell to which the data pulse (Dp) is supplied. The wall charges are formed within the cells selected by the address discharge to generate the discharge at the time of applying a sustain voltage. A positive direct current voltage (Zdc) is supplied to the sustain electrode (Z) to reduce a voltage difference between the sustain electrode (Z) and the scan electrode (Y) at the setdown period and the address period. By doing so, an erroneous discharge is prevented between the sustain electrode (Z) and the scan electrode (Y).

In the sustain period, a sustain pulse (sus) is supplied alternately to the scan electrodes (Y) and the sustain electrodes (Z). While the wall voltage of the cell is summed with the sustain pulse (sus), a sustain discharge (that is, a display discharge) is generated between the scan electrode (Y) and the sustain electrode (Z) at the cell, which is selected through the address discharge, whenever the sustain pulse (sus) is supplied.

After the completion of the sustain discharge, a ramp waveform (erase) having a small pulse width and voltage level is supplied to the sustain electrode (Z) to erase the wall charges remaining within the cells of the entire picture.

Meantime, in the PDP driven in the above method, when the positive data pulse (data) is applied to the address/data electrodes (X) and synchronized to the scan pulse at the address period, thereby discharging the cell, a voltage of the data pulse (i.e., the level of the data voltage Vd supplied to a data electrode X as the data pulse) drops depending on a discharge pattern of the discharge cell. This is because a switching load of the data electrode X is increased due to the large switching time at the data electrode depending on the discharge pattern of the discharge cell as shown in FIGS. 4*a*-5*b*. The discharge pattern means a pattern of data or a data pattern established by 0's and 1's. The switching time refers to a number of switchings from 0 to 1 or 1 to 0 within the data supplied to the data electrodes.

FIGS. 4*a*-5*b* illustrate data voltage characteristics depending on the discharge pattern of the discharge cell of a PDP according to the background art. In other words, FIGS. 4*a* and 4*b* illustrate the data voltage (Vd) characteristic at the address period when the discharge cell belonging to one line (e.g., X1) of the data electrode is continuously discharged, that is, when switching times for supplying the data pulse Dp (Data) are small. FIGS. 5*a* and 5*b* illustrate the data voltage (Vd) characteristic at the address period when the discharge cell belonging to one line (e.g., X1) of the data electrode is non-continuously and irregularly discharged, that is, when the switching times for supplying the data pulse Dp to the line X1 are large.

In case where the PDP has the discharge cell pattern having the small switching times for supplying the data pulses as shown in FIG. 4*a*, the data voltage (Vd) supplied to the data electrode X1 may drop slightly during the address period as shown in FIG. 4*b*. On the contrary, in case where the PDP has the discharge cell pattern having the large switching times for supplying the data pulse as shown in FIG. 5*a*, the voltage (Vd) supplied to the data electrode heavily drops during the address period as shown in FIG. 5*b*. This creates a drawback in that the erroneous discharge is generated due to the jittering such as a case where the address discharge is not sufficiently generated only with an exterior predetermined data voltage at the address period of the next sub-field since the drop of the data voltage is not sufficiently recovered during the sustain period.

In particular, this drawback is more prominent in the PDP using a single scan method. In the PDP using the single scan method, the switching load increases due to a longer line length of the data electrodes, which in turn causes an increase in the amount of data voltage drop for the data electrodes. Also there is a drawback in that when the PDP is driven at a high temperature, the erroneous discharge is easily caused due to the loss of the wall charge, because a motion of a spatial charge is activated within the cell and a recombination is easily generated.

SUMMARY OF THE INVENTION

Accordingly, an object of the present invention is to solve at least the above and other problems and disadvantages of the background art.

Another object of the present invention is to provide a driving device and method for a plasma display panel in which when the plasma display panel is driven, the sustain periods are varied depending on certain characteristics, thereby providing a stable discharge characteristic without an erroneous discharge.

Another object of the present invention is to provide a plasma display device including a plasma display panel and a driving part for driving the plasma display panel, which overcome the limitations and disadvantages associated with the background art.

To achieve these and other advantages and in accordance with the purpose of the present invention, as embodied and broadly described, there is provided a plasma display apparatus being driven by dividing a sub-field into at least an address period and a sustain period, the apparatus comprising: a timing controlling unit to vary a length of the sustain period according to a data pattern associated with at least one address electrode.

In accordance with another aspect of the present invention, there is provided a plasma display apparatus being driven by dividing a sub-field into at least an address period and a sustain period, the apparatus comprising: a timing controlling unit to adjust a length of the sustain period according to an amount of a switching load of an address electrode.

In accordance with a further another aspect of the present invention, there is provided a plasma display apparatus being driven by dividing a sub-field into at least an address period and a sustain period, the apparatus comprising: a timing controlling unit to adjust a length of the sustain period according to an amount of drop in a data voltage during the address period.

In accordance with a further another aspect of the present invention, there is provided a driving method for a plasma display apparatus being driven by dividing a sub-field into at least an address period and a sustain period, the method comprising: varying a length of the sustain period according to a data pattern associated with at least one address electrode.

In accordance with a further another aspect of the present invention, there is provided a driving method for a plasma display apparatus being driven by dividing a sub-field into at least an address period and a sustain period, the method comprising: varying a length of the sustain period according to an amount of a switching load of an address electrode.

In accordance with a further another aspect of the present invention, there is provided a driving method for a plasma display apparatus being driven by dividing a sub-field into at least an address period and a sustain period, the method comprising: varying a length of the sustain period according to an amount of drop in a data voltage during the address period.

The present invention has an effect in that when the plasma display panel is driven, a recovery period of a data pulse voltage is sufficiently provided in the sustain period to provide a stable discharge characteristic at each of the sub-fields without an erroneous discharge where the discharge of the discharge cell is turned off.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

Figure 1:
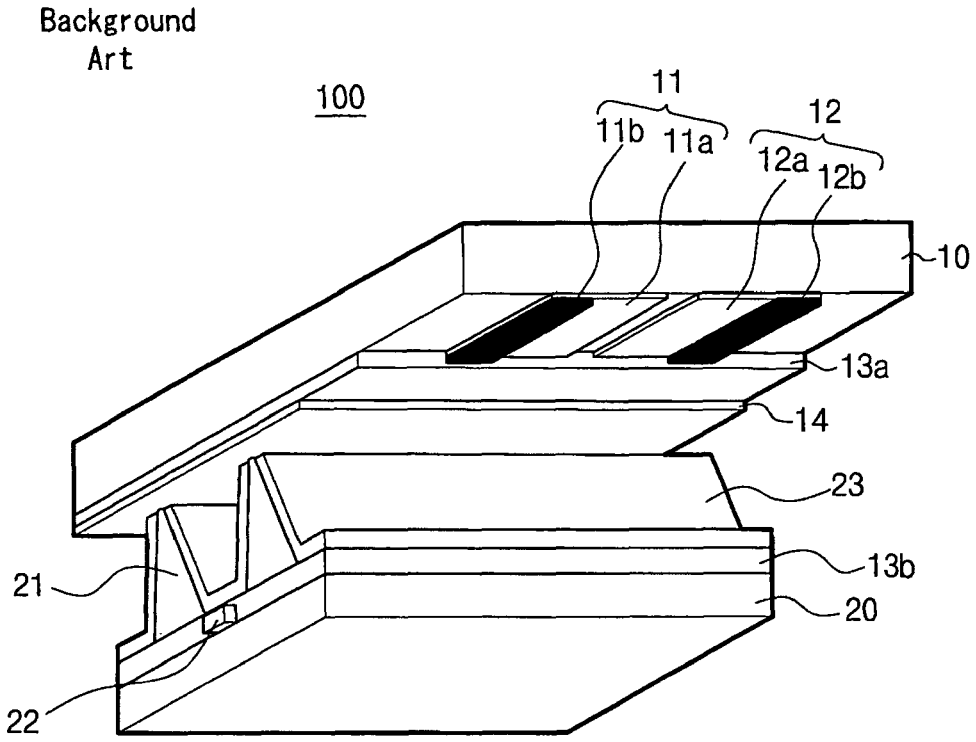
FIG. 1 is a perspective view illustrating a structure of a three-electrode alternate current surface discharge type plasma display panel (PDP) according to a background art.
Figure 2:
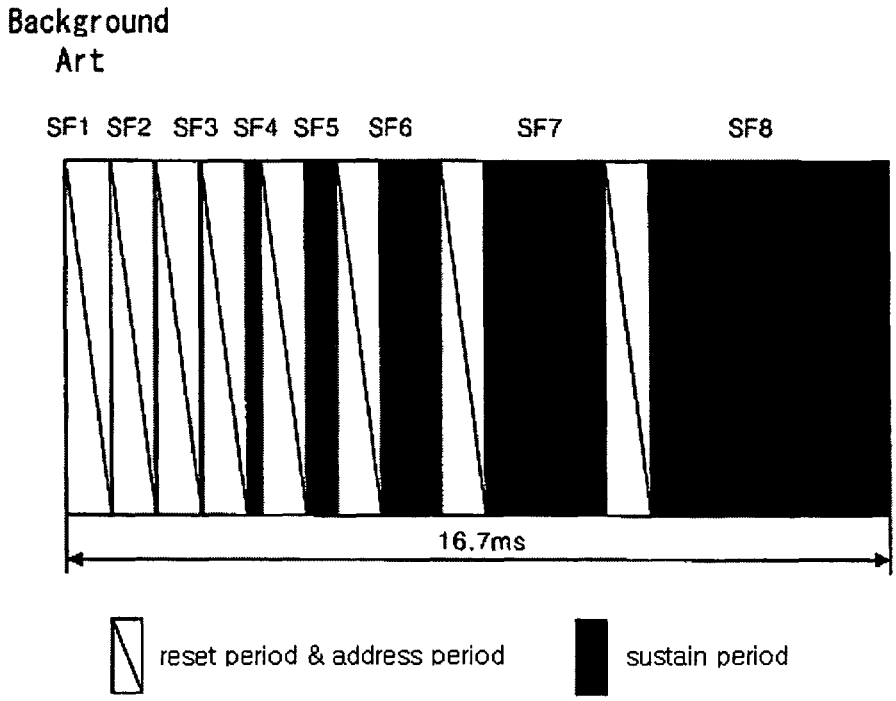
FIG. 2 is a view illustrating a method of expressing an image grayscale of the plasma display panel of FIG. 1.
Figure 3:
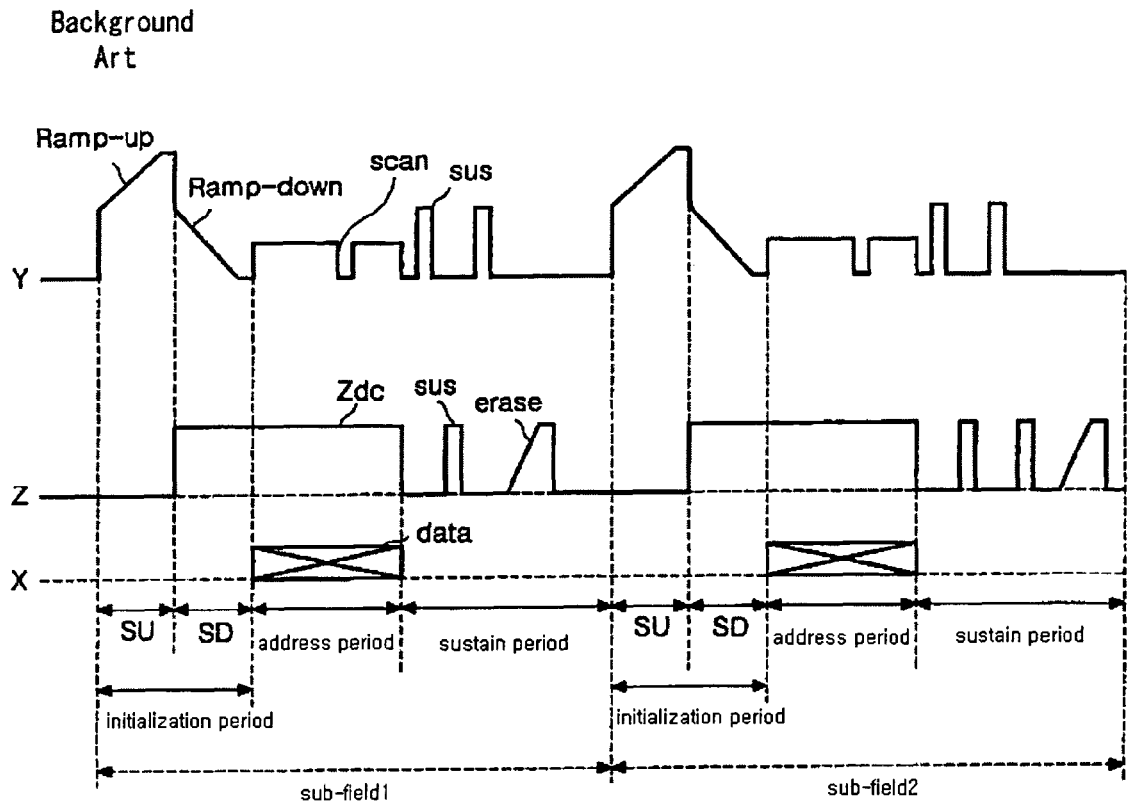
FIG. 3 is a view illustrating a waveform for describing a driving method for a plasma display panel according to a background art.
Figure 4A:
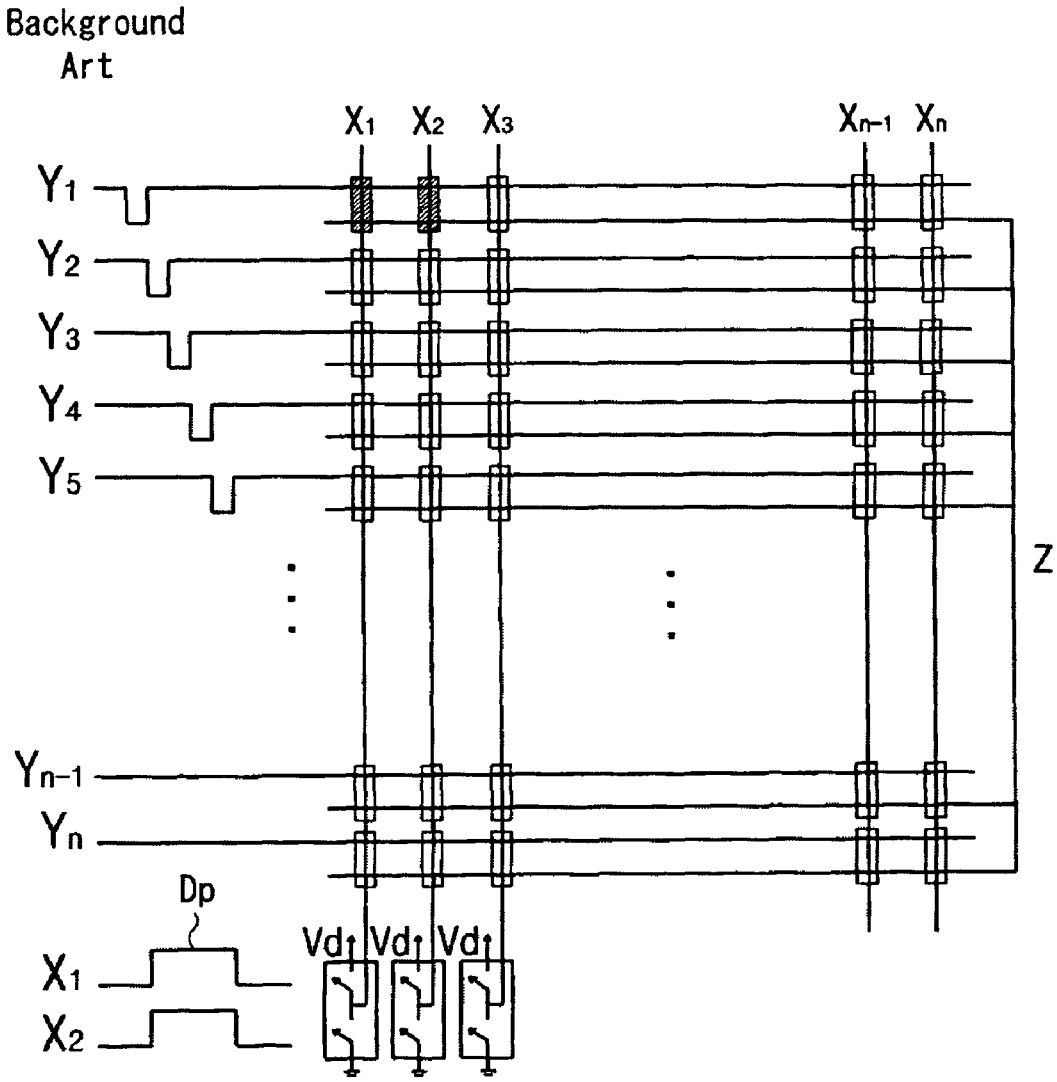
FIGS. 4*a*, 4*b*, 5*a* and 5*b* are views illustrating data voltage characteristics depending on a discharge pattern of a discharge cell of a plasma display panel according to a background art.
Figure 4B:
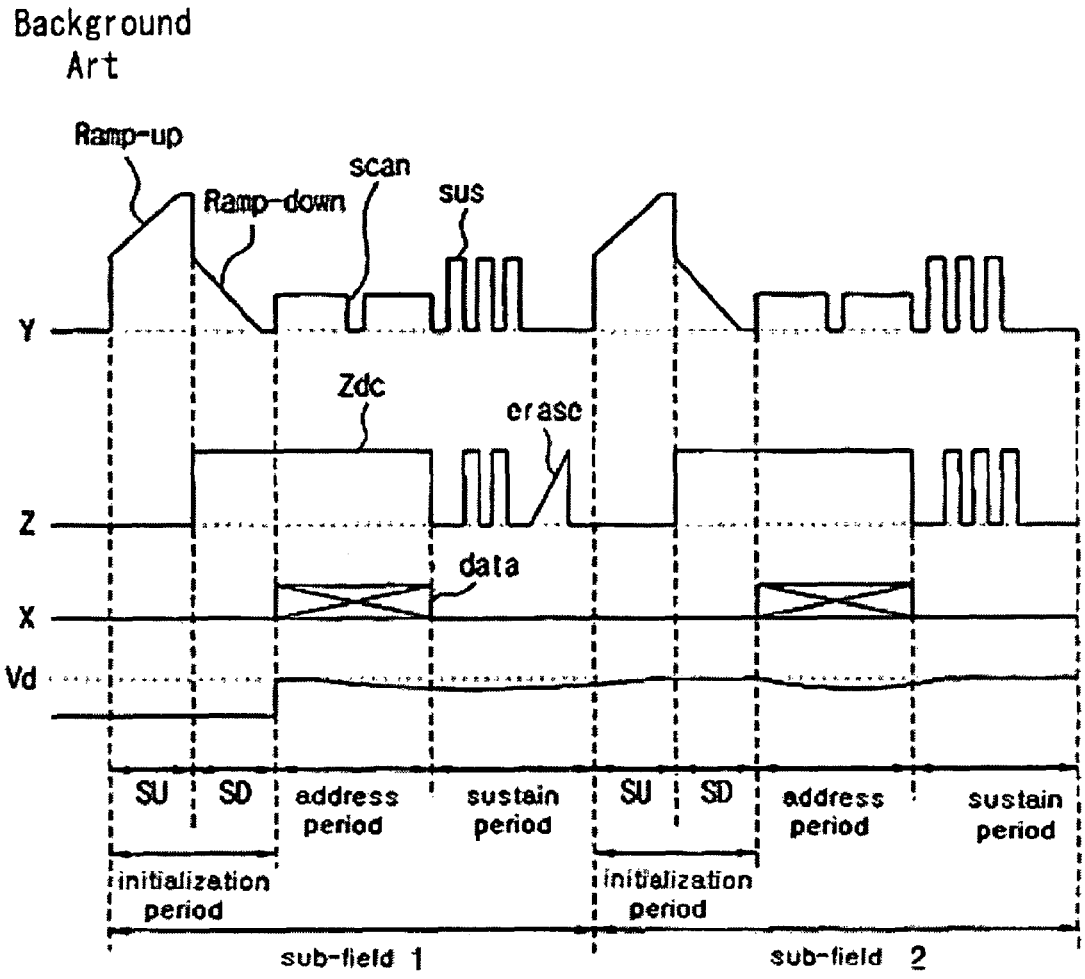
Figure 5A:
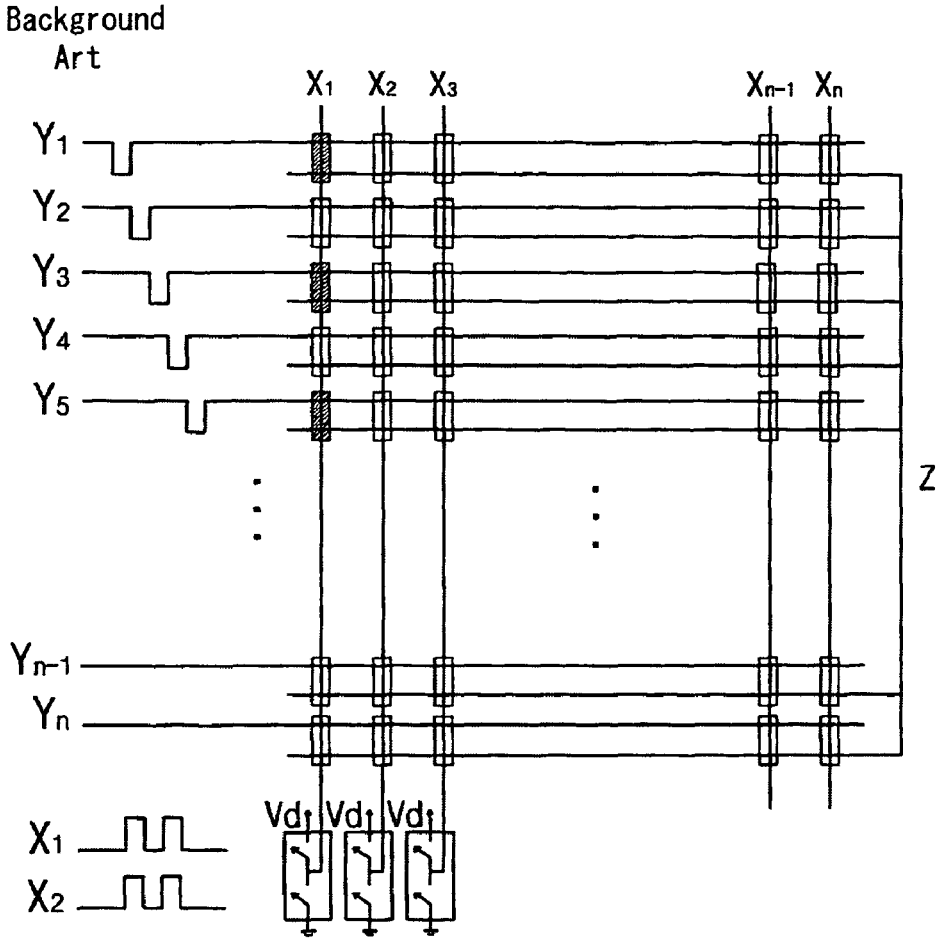
Figure 5B:
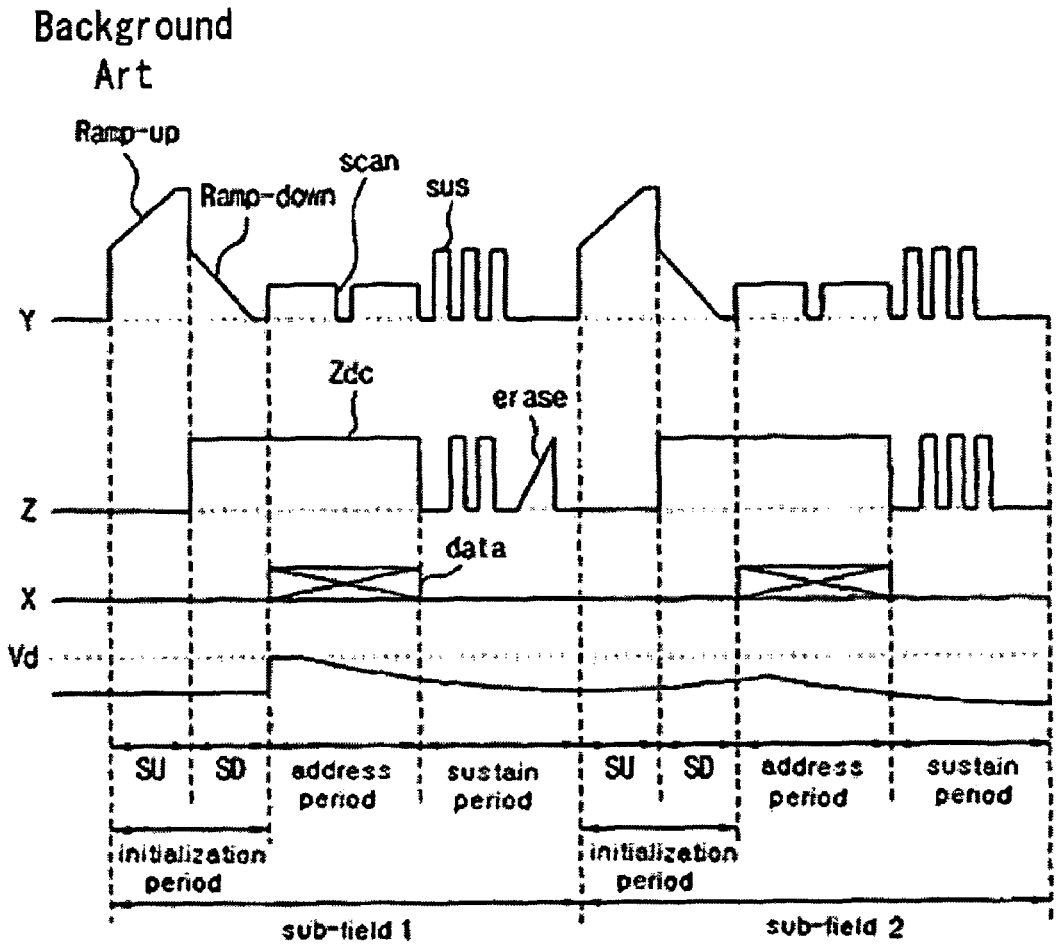
Figure 6A:
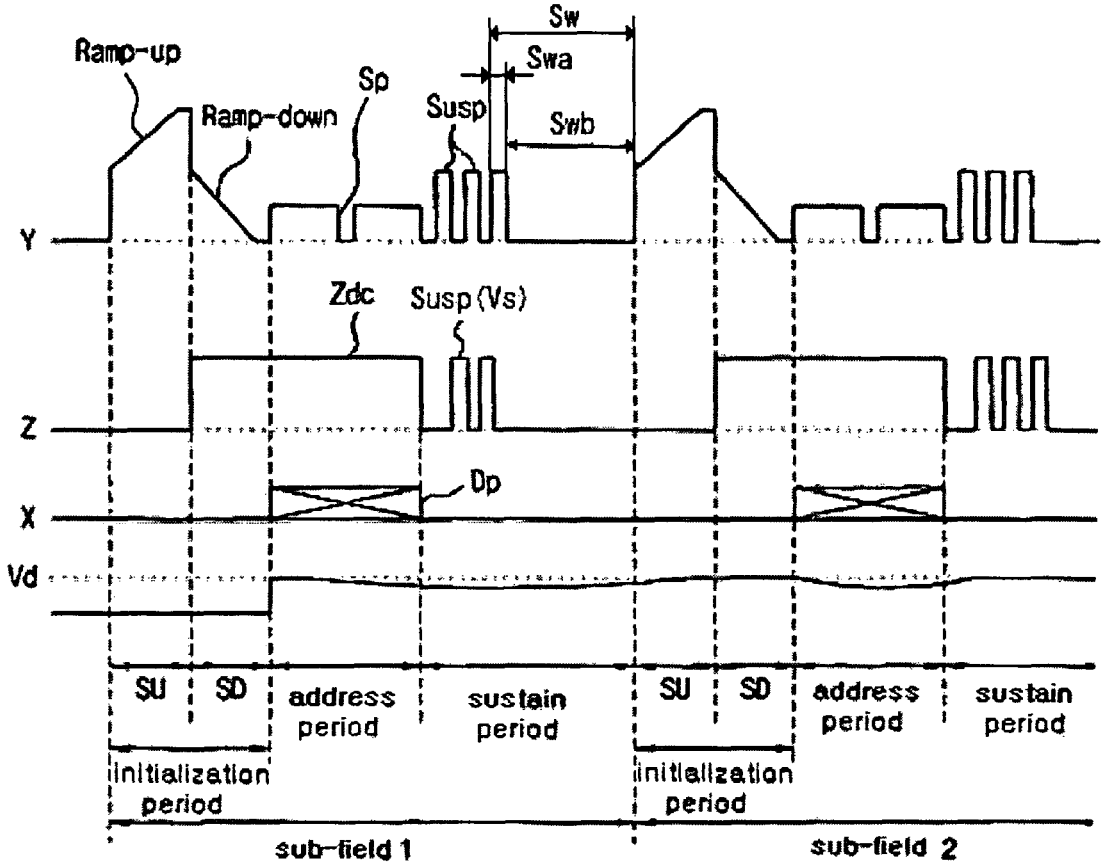
FIGS. 6*a* and 6*b* are views illustrating a data voltage characteristic and a waveform for describing a driving method for a plasma display panel according to the present invention.
Figure 6B:
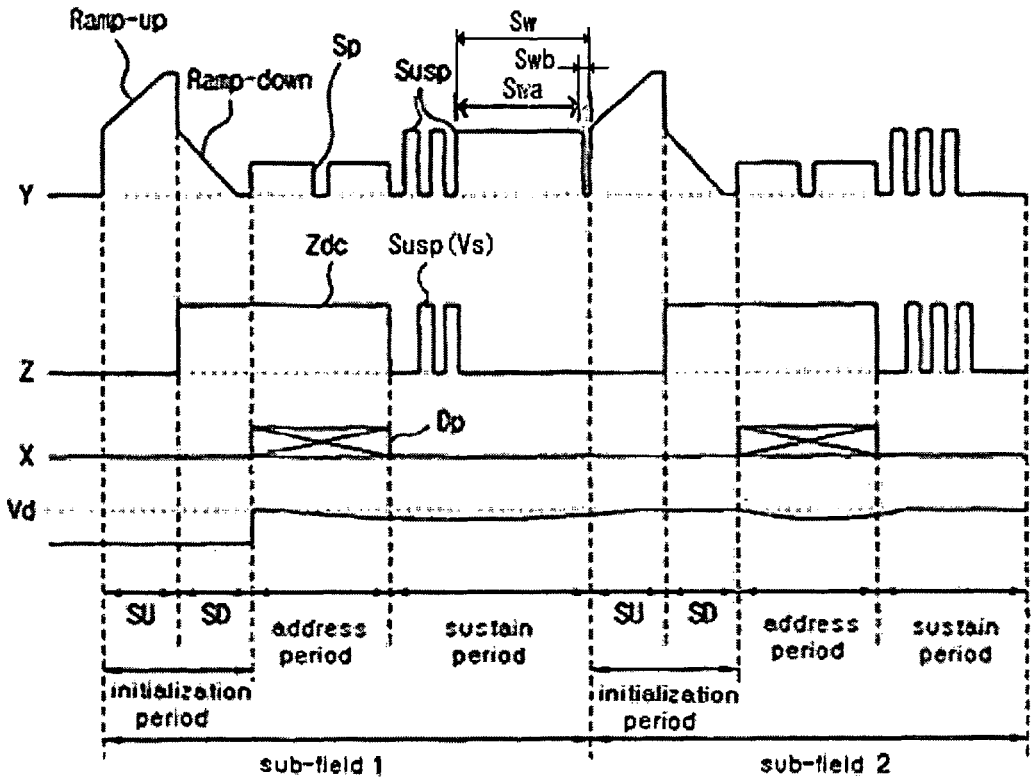

FIGS. 6*a* and 6*b* are views illustrating a data voltage characteristic and a waveform for describing a driving method for a plasma display panel according to the present invention.

Referring to FIGS. 6*a* and 6*b*, the plasma display panel is driven by dividing each sub-field of a frame into a reset/initialization period for initializing an entire picture, an address period for selecting a cell, and a sustain period for sustaining the discharge of the selected cell.

At a setup period (SU) of the reset period, a ramp-up waveform (Ramp-up) is concurrently supplied to all scan electrodes (Y). At the same time, 0 [V] is supplied to a sustain electrode (Z) and an address electrode (X). The ramp-up waveform causes a write dark discharge not almost generating light between the scan electrode (Y) and the address electrode (X) and between the scan electrode (Y) and the sustain electrode (Z) within cells of the entire picture. By the write dark discharge, positive (+) wall charges are accumulated on the address electrode (X) and the sustain electrode (Z), and negative (−) wall charges are accumulated on the scan electrode (Y).

Following the ramp-up waveform, a ramp-down waveform (Ramp-down) is concurrently supplied to the scan electrodes (Y) at a setdown period (SD). The ramp-down waveform begins to drop from a positive voltage lower than the peak voltage of the ramp-up waveform to a ground voltage (GND) or a specific positive voltage level. At the same time, a sustain voltage (Vs) in the form of pulses (Susp) is supplied to the sustain electrode (Z), and 0 [V] is supplied to the address electrode (X). When the ramp-down waveform is supplied as above, an erasure dark discharge is generated between the scan electrode (Y) and the sustain electrode (Z). By the erasure dark discharge, excessive wall charges unnecessary for an address discharge are erased among the wall charges generated in the write dark discharge. A distribution variation of the wall charge during the reset period will be described as follows. The wall charges are varied only slightly on the address electrode (X), and the negative wall charges generated in the write dark discharge on the scan electrode (Y) are partially reduced by the erasure dark discharge.

At the address period, a scan pulse (Sp) is sequentially supplied to the scan electrodes (Y) and at the same time, a data pulse (Dp) is supplied sequentially to the address electrodes (X) in synchronization with the scan pulse (Sp). While a voltage difference between the scan pulse (Sp) and the data pulse (Dp) is summed with a wall voltage generated during the reset period, the address discharge is generated within the cell to which the data pulse (Dp) is supplied. The address discharge can be performed in a dual scan method or a single scan method. In the dual scan method, the address discharge is respectively and independently performed in the plasma display panel divided into upper and lower parts. In the single scan method, the address discharge is performed at one time in the entire of the plasma display panel. Meantime, the positive direct voltage (Zdc) is supplied to the sustain electrode (Z) during the address period.

In the sustain period, a sustain pulse (Susp) of the sustain voltage (Vs) is alternately supplied to the scan electrodes (Y) and the sustain electrodes (Z). While the wall voltage of the cell is summed with a voltage of the sustain pulse (Susp), a sustain discharge (that is, a display discharge) is generated between the scan electrode (Y) and the sustain electrode (Z) at the cell, which is selected through the address discharge, whenever the sustain pulse (Susp) is supplied. At this time, the sustain period is varied by a controlling unit (e.g., a timing controller 121 in FIG. 7) depending on an amount of drop in the data voltage Vd applied to the address electrode (X). The data voltage drop amount is generated in the address discharge during the address period. Preferably, the timing controlling unit in the driving device of the PDP controls to lengthen the sustain period as the data voltage drop amount is increased. By varying the length of the sustain periods depending on the data voltage drop amount, the present invention provides a sufficient time during the sustain period of a current sub-field to recover the drop in the data voltage during the address period of the current sub-field, so that a stable discharge can be performed in the next sub-field.

The data voltage drop can be generated by various causes, but is mostly generated due to an increase in the switching load. The switching load is generated when a switching element of the address electrode (X) is switched on or off to write data in a necessary one of all cells of the plasma display panel. Accordingly, the present invention varies the length of the sustain period depending on the switching load amount The length of the sustain period can be controlled depending on the data voltage drop amount in different ways, for example, by varying a length of a supply period and a ground sustain period of a sustain pulse generating a first sustain discharge, or a length of a supply period and a ground sustain period of a sustain pulse generating other sustain discharge, among a plurality of sustain pulses supplied during the sustain period. However, according to an embodiment, it is desirable that the sustain period is controlled by varying a length of a period (Sw) from a start time point of a last sustain pulse of a current sub-field to a reset period start time point of a next sub-field.

In this regard, the period (Sw) extending from the initiation time point of the last sustain pulse supplied at the scan electrode (Y) in a current sub-field to the reset period start time point of the next sub-field can be varied in the range of 100 μs to 1 ms. The period Sw is made up of a supply period (Swa) and a ground period (SWb). At this time, the supply period (Swa) of the last sustain pulse for generating the last sustain discharge is a minimal period enough to generate the sustain discharge. Therefore, the supply period (Swa) has at least 1 μs. However, it is desirable that the supply period (Swa) is controlled to be at or less than 1 ms in consideration of a limited period from the sustain period initiation time point of the last sustain pulse to the reset period time point of the next sub-field.

In one example, as shown in FIG. 6*a*, the sustain pulse (Susp) can have a sustain waveform, wherein a last sustain pulse is supplied during a minute width period or the same width period as that of a previously supplied sustain pulse and is sustained to the ground level (GND) during the remaining part of the sustain period. In this case, the length of the sustain period is varied by varying the length of the ground period (SWb) of the last sustain pulse. The length of such ground period (SWb) may be varied within the range of 100 μs-1 ms.

In another example, as shown in FIG. 6*b*, the sustain pulse (Sp) can have a sustain waveform, wherein the last sustain pulse seems to be sustained to the sustain voltage (Vs) until the reset period start time point of the next sub-field. That is, in this case, the length of the sustain period is varied by varying the length of the supply period (SWa) of the last sustain pulse. The length of such supply period (SWa) may be varied within the range of 1 μs-1 ms.

The following discusses the reasons why the period from the sustain period initiation time point of the last sustain pulse to the reset period time point of the next sub-field is varied in the range of 100 μs to 1 ms according to one embodiment. Specifically, a minimal critical value of 100 μs or more is to sufficiently recover the data voltage, which drops at the address period, until before the address period of the next sub-field when the plasma display panel is driven. Further, a maximal critical value of 1 ms or less is to secure an operation margin of the sustain period when the plasma display panel is driven.

The inventive driving method for the plasma display panel can be applied to any one or more sub-fields in the plasma display panel driven through a combination of a plurality of sub-fields, to control the sustain period depending on the data voltage drop amount. For instance, the inventive driving method for the plasma display panel can be applied to at least any one sub-field to control the sustain period depending on the data voltage drop amount.

Accordingly, the present invention can sufficiently recover the data voltage drop amount of the address period during the sustain period to suppress the erroneous discharge, thereby preventing the discharge cell from being turned off when a write discharge is performed to write data during the address period of the next sub-field. Accordingly, a stable discharge can be performed at all of the sub-fields.

Figure 7:
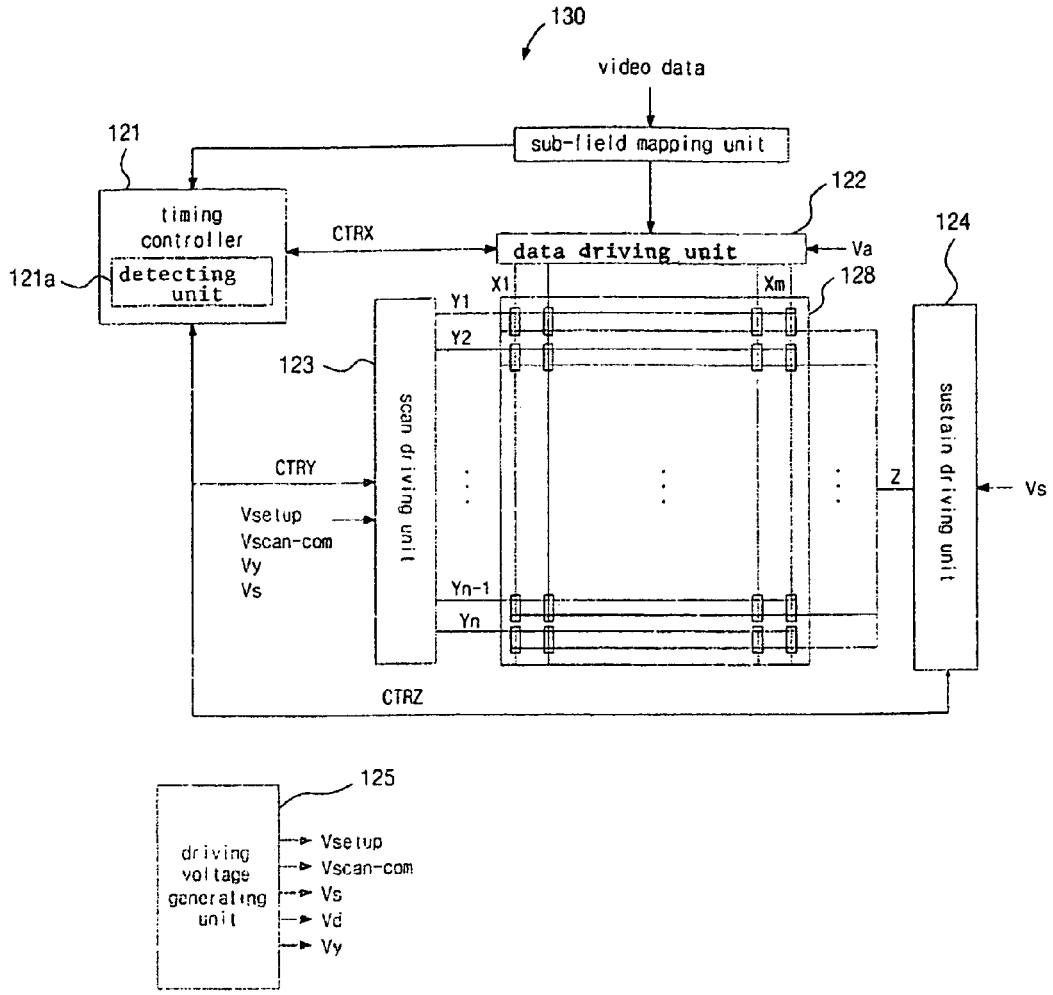
FIG. 7 is a view illustrating a driving device for a plasma display panel according to the present invention.

FIG. 7 is a view illustrating a plasma display panel having a drive device according to an embodiment of the present invention. The driving method according to the present invention as discussed above and below can be implemented in the device of FIG. 7 or other suitable device.

Referring to FIG. 7, the inventive driving device of the plasma display panel 130 includes a data driving unit 122 for supplying data to the address electrodes (X1 to Xm) of a panel 128; a scan driving unit 123 for driving the scan electrodes (Y1 to Yn); a sustain driving unit 124 for driving the sustain electrodes (Z) being common electrodes; a timing controlling unit 121 for controlling the data driving unit 122, the scan-driving unit 123 and the sustain driving unit 124; and a driving voltage generating unit 125 for supplying a driving voltage necessary for each of the driving units 122, 123 and 124. All the components of the PDP including the driving device are operatively coupled.

Video data is inputted from the exterior to an inverse gamma correction unit (not shown) and an error diffusion unit (not shown) for inverse gamma correction and error diffusion. This process is known. After that, the inputted video data is mapped to each of the sub-fields through a sub-field mapping unit 120. The sub-field mapping unit 120 supplies the mapped data to the data driving unit 122 and to the timing controlling unit 121. The data driving unit 122 samples and latches the received data in response to a timing control signal (CTRX) of the timing controlling unit 121 and then, supplies the latched data to the address electrodes (X1 to Xm).

The scan driving unit 123 supplies the ramp-up waveform and the ramp-down waveform to the scan electrodes (Y1 to Yn) during the reset period under the control of the timing controlling unit 121. Further, the scan driving unit 123 sequentially supplies the scan pulse (Sp) of the scan voltage (Vy) to the scan electrodes (Y1 to Yn) during the address period under the control of the timing controlling unit 121. The scan driving unit 123 supplies the sustain pulse (Susp) of the sustain voltage (Vs), which is controlled depending on the data voltage drop amount determined in the timing controlling unit 121, to the scan electrodes (Y1 to Yn) during the sustain period.

The sustain driving unit 124 is controlled under the control of the timing controlling unit 121 to supply a bias voltage of the sustain voltage (Vs) to the sustain electrodes (Z) during the address period and a period for generating the ramp-down waveform. Further, the sustain driving unit 124 is operated alternately with the scan driving unit 123 during the sustain period to supply the sustain pulse (Susp) to the sustain electrodes (Z). Further, the sustain driving unit 124 can also supply the erasure ramp waveform (Vramp-ers) to the sustain electrodes (Z) if the last sustain discharge is finished at one sub-field.

The timing controlling unit 121 receives vertical and horizontal synchronous signals and a clock signal, and generates timing control signals (e.g., CTRX, CTRY and CTRZ) to control each of the driving units 122, 123 and 124. The timing controlling unit 121 supplies the timing control signals (CTRX, CTRY and CTRZ) respectively to the corresponding driving units 122, 123 and 124 to control an operation of each of the driving units 122, 123 and 124. The timing controlling unit 121 includes a detecting unit 121*a*; however, the detecting unit 121*a* can be separately provided from the timing controlling unit 121. For instance, the detecting unit 121*a* can be an independent entity or can be part of another element in the device, e.g., the data driving unit 122.

In one example, the detecting unit 121*a* detects a data voltage drop amount, which is generated in plasma discharge at the address period, by using data allocated to each of the sub-fields in the sub-field mapping unit 120. The drop in the data voltage can be detected by, e.g., examining the data voltage at the data/address electrode(s). As the data voltage drop increases, the length of the period Sw of the sustain period may be increased. In another example, the detecting unit 121*a* can detect an amount of switching load, e.g., by detecting a number of switchings between 0's and 1's in the data supplied to the data electrode(s). As the switching number increases, the length of the period Sw may increase. In another example, the detecting unit 121*a* can detect a data pattern of the data supplied to the data electrode(s). By detecting the data pattern, a number of switchings between 0's and 1's in the data pattern is detected. As the number of switchings increases, the length of the period Sw may increase.

The timing controlling unit 121 generates a control signal corresponding to the data voltage drop amount (or the switching load or the data pattern) detected in the amount detecting unit 121*a*, to supply the generated control signal to the scan driving unit 123. The switching load is generated depending on the discharge pattern of the discharge cell. The discharge pattern is determined depending on a pattern of data (data pattern) inputted to the data driving unit 122.

Further, the control signal corresponding to the detection by the detecting unit 121*a* controls the length of the sustain period and preferably, controls the period from the sustain period initiation time point of the last sustain pulse to the reset period time point of the next sub-field.

By the control signal corresponding to the detection result provided by the detecting unit 121*a*, e.g., by the signal for controlling the period (SWb) from the sustain initiation time point of the last sustain pulse to the reset period time point of the next sub-field, this period is controlled, e.g., it is lengthened by the timing controlling unit 121 as the data voltage drop amount is increased. At this time, the period from the sustain initiation time point of the last sustain pulse to the reset period time point of the next sub-field can be controlled to be within the range of 100 μs to 1 ms.

As aforementioned, the following are the reasons why the period from the sustain initiation time point of the last sustain pulse to the reset period time point of the next sub-field is controlled to be within the range of 100 μs to 1 ms. The minimal critical value of 100 μs or more is to sufficiently recover the data voltage, which drops at the address period, until before the address period of the next sub-field when the plasma display panel is driven. The maximal critical value of 1 ms or less is to secure the operation margin of the sustain period when the plasma display panel is driven.

At the period from the initiation time point of the last sustain pulse of a current sub-field to the reset period time point of the next sub-field, the supply period of the sustain pulse for generating the last sustain discharge is a minimal period enough to generate the sustain discharge. Therefore, the supply period has at least 1 μs. However, it is desirable that the supply period is controlled to be less than 1 ms in consideration of the limited period from the sustain period initiation time point of the last sustain pulse to the reset period time point of the next sub-field.

When the inventive driving method of controlling the sustain period depending on the data voltage drop amount (or switching load or data pattern) is applied to the plasma display panel for generating the address discharge in a single scan method, a data voltage recovery efficiency is more increased. Further, the inventive driving method for the plasma display panel can be applied to only any one single sub-field in the plasma display panel, which is driven through the combination of the plurality of sub-fields, to control the sustain period depending on the detection by the detecting unit 121*a*. However, the inventive driving method for the plasma display panel can be applied to all of the plurality of sub-fields or at least any one sub-field to control the sustain period depending on the detection by the detecting unit 121*a* (i.e., data voltage drop amount, switching load, or a data pattern). That is, the inventive driving method can be applied to at least one sub-field to control the sustain period. Especially, it is desirable that the inventive driving method is applied only to front half sub-fields (SF1, SF2 and SF3) of the plasma display panel, which is driven with at least eight sub-fields, to control the sustain period in consideration of a sustain driving margin and a jittering phenomenon occurring during the address period.

Meantime, among the signals controlled by the timing controlling unit 121, the data control signal (CTRX) includes a sampling clock for sampling the data, a latch control signal, and a switch control signal for controlling a turn-on/off time of the driving switching element and an energy recovery circuit.

The scan control signal (CTRY) includes a switch control signal for controlling a turn-on/off time of a driving switching element and an energy recovery circuit, which are installed in the scan driving unit 123.

The sustain control signal (CTRZ) includes a switch control signal for controlling a turn-on/off time of a driving switching element and an energy recovery circuit, which are installed in the sustain driving unit 124.

The driving voltage generating unit 125 generates a setup voltage (Vsetup), a scan common voltage (Vscan-com), the scan voltage (−Vy), the sustain voltage (Vs), the data voltage (Vd) and the like. These driving voltages can be varied depending on a composition of a discharge gas or a structure of the discharge cell.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus being driven by dividing a sub-field into at least an address period and a sustain period, the apparatus comprising:

a timing controlling unit configured to vary a length of the sustain period depending on a discharge pattern of a discharge cell, wherein the discharge pattern of the discharge cell varies in accordance with a number of switching operations of a data voltage applied to an address electrode, wherein the timing controlling unit is further configured to lengthen the length of the sustain period by lengthening a length from an initiation time point of a last sustain pulse to a reset period of a next sub-field, and lengthen the length from the initiation time point of the last sustain pulse to the reset period of the next sub-field by lengthening a ground period of the last sustain pulse in the sustain period, as the number of switching operations of the data voltage is higher, in order to recover the data voltage drop amount during the sustain period, and wherein the data voltage rises during a period between the initiation time point of the last sustain pulse and the reset period of the next sub-field.

2. The apparatus of claim 1, wherein the timing controlling unit is configured to vary the length from the initiation time point of the last sustain pulse to the reset period of the next sub-field by varying a supply period of the last sustain pulse in the sustain period.

3. The apparatus of claim 2, wherein the timing controlling unit is configured to vary the supply period of the last sustain pulse in the range of 1 μs-1 ms.

4. The apparatus of claim 1, wherein the timing controlling unit is configured to vary the ground period of the last sustain pulse in the range of 100 μs-1 ms.

5. The apparatus of claim 1, further comprising:

a plasma display panel controlled by the timing controlling unit.

6. The apparatus of claim 1, further comprising:

a detecting unit configured to detect the data pattern.

7. The apparatus of claim 1, wherein a length of a sustain period of a discharge cell corresponding to a continuously discharged line of the at least one address electrode is greater than a length of a sustain period of a discharge cell corresponding to a noncontinuously discharged line of the at least one address electrode.

8. A plasma display apparatus being driven by dividing a sub-field into at least an address period and a sustain period, the apparatus comprising:

a timing control unit configured to vary a length of the sustain period according to an amount of drop in a data voltage applied to at least one address electrode during the address period, the timing control unit configured to detect a discharge pattern of the data voltage applied to the at least one electrode, the amount of drop corresponding to a number of switchings in the detected discharge pattern; and increase or decrease the length of the sustain period as the number of switchings corresponding to the detected data pattern increases or decreases, wherein the timing controlling unit is further configured to lengthen the length of the sustain period by lengthening a length from an initiation time point of a last sustain pulse to a reset period of a next sub-field, and lengthen the length from the initiation time point of the last sustain pulse to the reset period of the next sub-field by lengthening a ground period of the last sustain pulse in the sustain period, as the number of switching operations of the data voltage is higher, in order to recover the data voltage drop amount during the sustain period, and wherein the data voltage rises during a period between the initiation time point of the last sustain pulse and the reset period of the next sub-field.

9. The apparatus of claim 8, wherein the timing controlling unit is configured to vary the length from the initiation time point of the last sustain pulse to the reset period of the next sub-field by varying a supply period of the last sustain pulse in the sustain period.

10. The apparatus of claim 9, wherein the timing controlling unit is configured to vary the supply period of the last sustain pulse in the range of 1 μs-1 ms.

11. The apparatus of claim 8, wherein the timing controlling unit is configured to vary the ground period of the last sustain pulse in the range of 100 μs-1 ms.

12. The apparatus of claim 8, further comprising:

a plasma display panel controlled by the timing controlling unit.

13. The apparatus of claim 8, further comprising:

a detecting unit configured to detect the amount of the data voltage drop during the address period.

14. The apparatus of claim 8, wherein a length of a sustain period of a discharge cell corresponding to a continuously discharged line of the at least one address electrode is greater than a length of a sustain period of a discharge cell corresponding to a noncontinuously discharged line of the at least one address electrode.

15. A plasma display apparatus being driven by dividing a sub-field into at least an address period and a sustain period, the apparatus comprising:

a timing controlling unit configured to vary a length of the sustain period depending on a discharge pattern of a discharge cell, wherein the discharge pattern of the discharge cell varies in accordance with a number of switching operations of a data voltage applied to an address electrode, wherein the timing controlling unit is further configured to shorten the length of the sustain period by shortening a length from an initiation time point of a last sustain pulse to a reset period of a next sub-field, and shorten the length from the initiation time point of the last sustain pulse to the reset period of the next sub-field by shortening a ground period of the last sustain pulse in the sustain period, as the number of switching operations of the data voltage is lower, in order to recover the data voltage drop amount during the sustain period, and wherein the data voltage rises during a period between the initiation time point of the last sustain pulse and the reset period of the next sub-field.

* * * * *